United States Patent [19]

Kruger

[11] Patent Number: 4,646,920

[45] Date of Patent: Mar. 3, 1987

[54] JEWELRY DISPLAY STAND

[76] Inventor: David B. Kruger, 7806 Lindenwood Cir., Austin, Tex. 78767

[21] Appl. No.: 836,631

[22] Filed: Mar. 5, 1986

[51] Int. Cl.[4] ..... A47F 7/02

[52] U.S. Cl. ..... 211/13; 206/566

[58] Field of Search ..... 211/13; 248/176; 206/565, 566

[56] References Cited

U.S. PATENT DOCUMENTS 3,197,166 7/1965 Sandler ..... 206/566 X 3,289,853 12/1966 Eichorn et al. ..... 211/13

4,180,169 12/1979 Michels ..... 211/13

4,391,375 7/1983 Joyce ..... 211/13

*Primary Examiner*—Robert W. Gibson, Jr.

*Attorney, Agent, or Firm*—Leitner, Greene & Christensen

[57] ABSTRACT

A jewelry display stand formed of transparent material and comprising a base member having a tab member for holding a ring or the like and a tag retainer removeably affixed to the base member so that the stand can be used with or without the tag retainer.

5 Claims, 5 Drawing Figures

JEWELRY DISPLAY STAND

BACKGROUND OF THE INVENTION

This invention relates to jewelry display stand, and more particularly to a stand that may be used to display one or more rings along with a price tag or other kind of indica tag.

The use of display stands for rings is well known as shown, for example, in U.S. Pat. No. 3,645,403 in which an L-shaped device is described having a resilient arcuate tab member for holding a ring. The device does not include any provision for holding tags to indicate price, ring type, etc. It is desirable to include some type of device to hold tags in a neat manner in the jewelry case or in the window display. If a tag is merely laid next to the ring to which it relates, when the ring is moved or sold, the tag may remain or the tag may be inadvertently moved so that the tag may wind up adjacent the wrong ring.

To overcome the aforementioned problem, jewelry display stands have been proposed such as, for example, as shown in U.S. Pat. No. 3,289,853 which includes a tag retainer for holding a tag on the display holder. However, the stand in this patent includes numerous parts and necessitates a complete disassembly if the tag retainer is not needed.

There thus exists a need for an inexpensive jewelry display stand incorporating a tag retainer that may be readily removed if a tag is not needed on the display.

OBJECTS OF THE INVENTION

It is an object of the present invention to provide a new and improved display stand for rings incorporating a tag retainer.

It is another object of the present invention to provide a new and improved jewelry display stand which can be used with or without the tag retainers.

It is yet another object of the present invention to provide a jewelry display stand in which the tag retainer can be readily removed without the need to remove the jewelry supported on the stand.

It is still yet another object of the present invention to provide a jewelry display stand that can be easily made in different sizes and which is relatively easy to manufacture and inexpensive in cost.

SUMMARY OF THE INVENTION

The above outlined objectives as well as other objects and features of the present invention are accomplished by a jewelry display stand formed of transparent material and comprising a face member and a leg member with the face member having a tab member for holding a ring and a tag retainer removably affixed to the face member so that the stand can be used with or withour the tag retainer.

BRIEF DESCRIPTION OF THE DRAWINGS

For a full understanding of the nature and objects of the invention, reference should be had to the following detailed description taken in conjunction with the accompanying drawings in which.

DESCRIPTION OF THE PREFERRED EMBODIMENT

Figure 1:
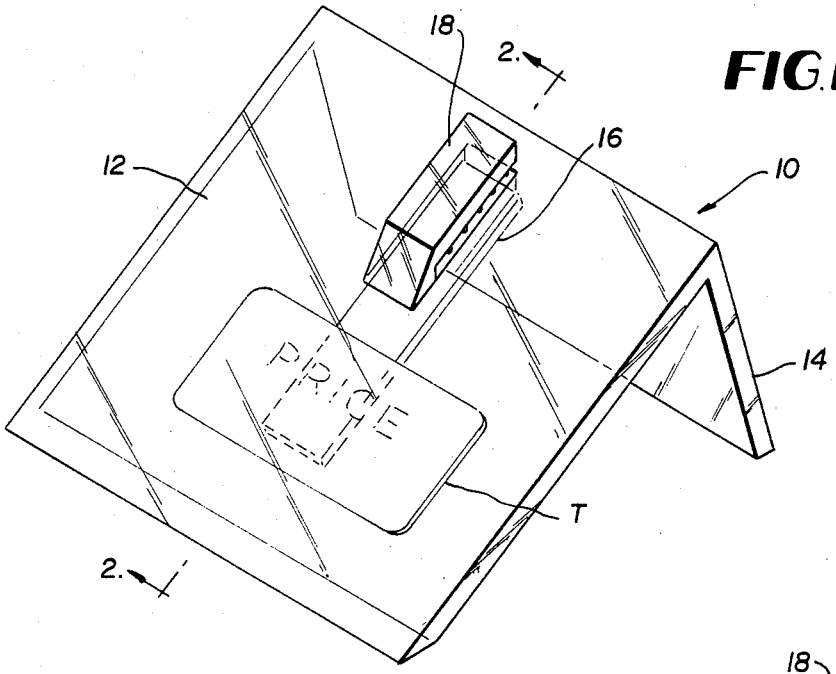
FIG. 1 is a perspective view of a jewelry display stand constructed in accordance with the present invention.

Referring now to the drawing in detail, where like reference numerals indicate like parts throughout the several figures, reference numeral 10 indicates the jewelry display stand of the present invention. The stand 10 is preferably made of transparent plastic material such as clear or tinted acrylic plastic so that a tag T is visible although supported on the back of the stand 10.

The stand 10 includes a face member 12 and a leg member 14 extending at an angle from the face member 12 so that when in use the face member 12 is in an inclined position to appropriately display a ring or bracelet and to readily permit the indicia on tag T to be viewed. Obviously, the angle that the leg member 14 extends from the face member 12 will depend on the relative lengths of the two members 12, 14 but it is preferred that the face member be inclined approximately 30 degrees from the horizontal.

The stand 10 further includes a separate retainer member 16 for holding the tag T in position. As will be discussed below, the retainer member 16 is connected to face member 12 so that it can be easily removed if a tag is not needed.

The face member 12 includes an integrally formed substantially planar support member 18 having a chamfered free end 20 so that movement of a piece of jewelry such as a ring R onto the support member 18 will tend to slightly pivot the support member about its connected end to permit the ring to be placed on the support member 18. The underside of the support member 18 includes a series of protuberances 22 to frictionally retain the ring or bracelet in position.

Figure 2:
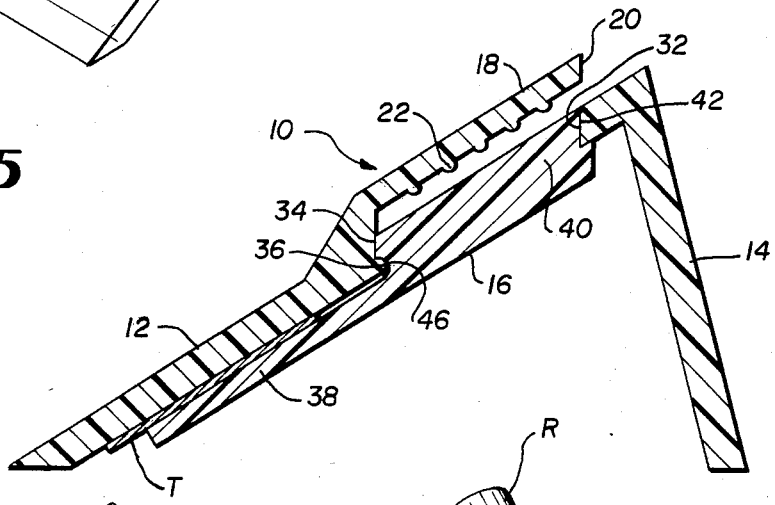
FIG. 2 is a sectional view taken along the line 2—2 of FIG. 1 looking in the direction of the arrows.
Figure 5:
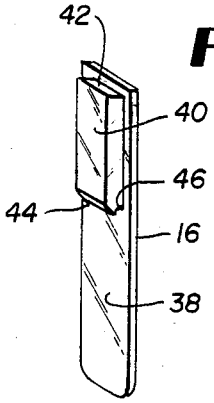
FIG. 5 is a perspective view of the tag retainer.
Figure 4:
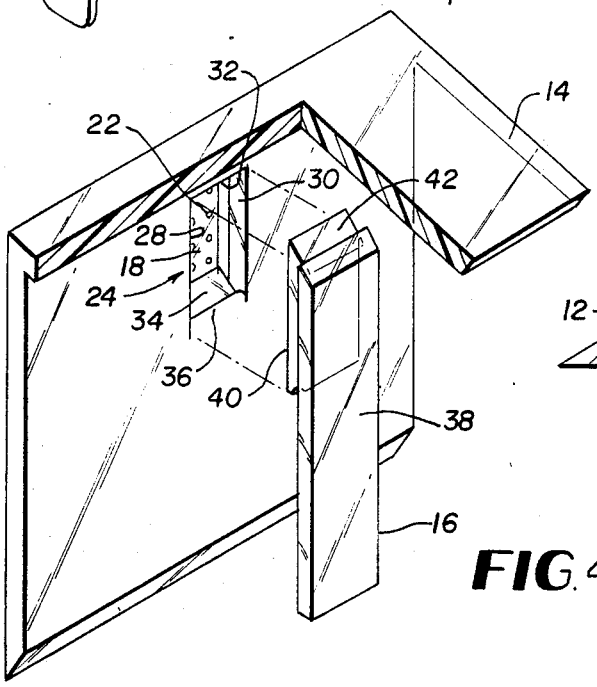
FIG. 4 is an exploded view partially broken away of the parts of the device.

As best seen in FIGS. 2 and 4, a retainer holding means 24 is formed in face member 12 directly below support member 18. As will be obvious to one skilled in the art, the retainer holding means 24 is preferably formed during the molding process at the same time that the support member 18 is formed. The retainer holding means 24, as shown best in FIGS. 2 and 4, includes an opening 26 as defined by opposing straight walls 28, 30 and opposing sloped walls 32, 34. The size of the opening 26 is substantially the same size as support member 18. As seen best in FIG. 2, and for reasons discussed below, the lower sloped wall 34 includes a rib member 36.

The retainer member 16 is formed to have a tight press fitting relationship in retainer holding means 24 and retainer member 16 includes a base portion 38 and an upper portion 40. The base portion 38 is formed of sufficient longitudinal dimension so that when in position against face member 12, a substantial part of base portion 38 will be available to securely retain a tag T between it and the underside of face member 12. The upper portion 40 which serves as a connecting means with retainer holding means 24 is preferably integrally formed with base portion 34 and is of substantially rectangular shape with end walls 42 and 44 being chamfered to cooperate with sloped wall 32 and sloped wall 34 of retainer holding means 24 respectively. A portion of sloped wall 44 has a undercut 46 to receive rib member 36. As shown in FIG. 4, the upper portion 40 is positioned on base portion 38 so that a portion of base portion 38 surrounds the upper portion 40 and acts as a stop when the upper portion 40 is inserted into opening 26 of the retainer holding means 24.

Figure 3:
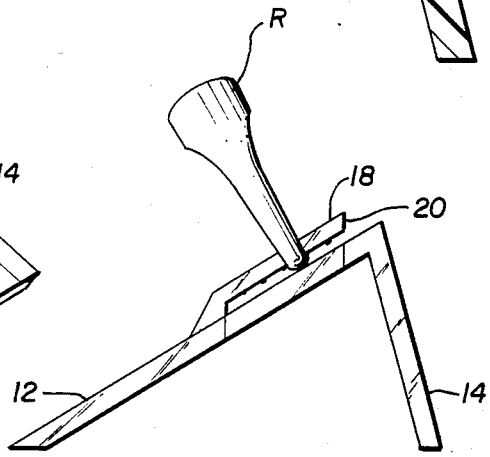
FIG. 3 is a side elevational view with the tag retainer removed and a ring in position.

The use and operation of the jewelry display stand 10 should be obvious from the above description. The stand 10 may be used without the retainer member 16 as shown in FIG. 3. If it is desired to use a tag T with the stand 10, the retainer member 16 is attached to the face member 12 by pressing the upper portion 40 into opening 26 until the base portion 38 is flush against the face member 12 and rib member 36 is in the undercut 46. The rib member 36 and the undercut 46 tend to cooperate together to tightly hold the retainer member 16 in position on the face member so that base portion 38 is tightly pressed against face member 12. The tag T is then placed between the base portion 38 and the face member 12 where it is tightly held in position. Removal of the retainer member 16 is easily accomplished by placing a stiff flat member between the base portion 38 and the face member 12 adjacent upper portion 40 and exerting sufficient force against the base portion 38.

It will thus be seen that the objects set forth above are efficiently attained and since certain changes may be made in the above construction without departing from the scope of the invention, it is intended that all matter contained in the above description shall be interpreted as illustrative and not in a limiting sense.

What is claimed is:

1. A jewelry display stand comprising a face member, a leg member and a tag retainer, said face member including a tab member for supporting a piece of jewelry and a retainer holding means, said tag retainer being of substantially rectangular shape and including connecting means thereof at one end for attaching to said retainer holding means whereby said tag retainer may be removeably positioned against said face member for holding indicia means between said tag retainer and said face member.

2. The jewelry display stand of claim 1 wherein said face member, said leg member and said tag retainer are composed of clear plastic material.

3. The jewelry display stand of claim 1 wherein said retainer holding means comprises an opening surrounded by four edges and said connecting means on said tag retainer is adapted to be frictionally held in said opening.

4. The jewelry display stand of claim 3 wherein a first one of said edges is sloped and a second opposed edge is sloped with a rib member therein, said connecting means on said tag retainer includes a chamfered edge compatible with said first one of said edges and a chamfered edge and undercut compatible with said second opposed edge and rib member.

5. The jewelry display stand of claim 4 wherein said tag retainer has an elongated rectangular body and said connecting means is located at one end of said body and slightly inward from the adjacent edges of said tag retainer elongated rectangular body whereby when said connecting means is placed into said retainer holding means opening, said rectangular body will be against said face member to prevent further movement of said connecting means in said opening.

* * * * *